US008281845B2

(12) United States Patent
Seidel

(10) Patent No.: US 8,281,845 B2
(45) Date of Patent: Oct. 9, 2012

(54) ROLL-UP RETRACTABLE SHEET DEVICE

(76) Inventor: Gregg Seidel, Manhattan Beach, CA (US)

( * ) Notice: Subject to any disclaimer, the term of this patent is extended or adjusted under 35 U.S.C. 154(b) by 0 days.

(21) Appl. No.: 12/309,839

(22) PCT Filed: Jul. 27, 2007

(86) PCT No.: PCT/US2007/016845

§ 371 (c)(1),
(2), (4) Date: Jan. 30, 2009

(87) PCT Pub. No.: WO2008/016542

PCT Pub. Date: Feb. 7, 2008

(65) Prior Publication Data

US 2009/0194627 A1 Aug. 6, 2009

Related U.S. Application Data

(60) Provisional application No. 60/834,665, filed on Aug. 1, 2006.

(51) Int. Cl.
*A47G 5/02* (2006.01)

(52) U.S. Cl. ..... 160/315; 160/313

(58) Field of Classification Search ..... 160/133, 160/238, 315, 313; 242/365.9, 253, 395, 242/394; 81/461
See application file for complete search history.

(56) References Cited

U.S. PATENT DOCUMENTS 1,227,724 A * 5/1917 Wise ..... 160/315
1,341,530 A * 5/1920 Wise ..... 160/315
1,934,103 A * 11/1933 Traut ..... 160/31
1,947,070 A * 2/1934 Traut ..... 160/23.1
2,060,676 A * 11/1936 Kuyper ..... 160/315
2,110,048 A * 3/1938 May ..... 160/300
2,932,057 A * 4/1960 Pemberton ..... 16/198
4,142,283 A * 3/1979 Walker et al. ..... 29/227
4,253,350 A * 3/1981 De Tarr ..... 81/486
4,413,665 A * 11/1983 Corcoran ..... 160/315
4,817,927 A * 4/1989 Martin ..... 267/155
4,981,165 A * 1/1991 Miller et al. ..... 160/191
5,031,682 A * 7/1991 Tedeschi ..... 160/315
5,577,544 A * 11/1996 Carper et al. ..... 160/191
5,605,079 A * 2/1997 Way ..... 81/61
5,632,063 A * 5/1997 Carper et al. ..... 16/198
5,778,490 A * 7/1998 Curtis ..... 16/198
6,230,582 B1 * 5/2001 Becker et al. ..... 74/545
6,263,942 B1 * 7/2001 Miller ..... 160/23.1
6,283,193 B1 * 9/2001 Finch et al. ..... 160/191
6,302,179 B1 * 10/2001 Miller ..... 160/23.1
6,453,975 B2 * 9/2002 Miller ..... 160/315
6,527,037 B2 * 3/2003 Daus et al. ..... 160/315
6,735,905 B1 * 5/2004 Miller ..... 49/200
6,896,027 B2 * 5/2005 Crouch ..... 160/315
6,959,751 B2 * 11/2005 Savard et al. ..... 160/315
7,325,584 B2 * 2/2008 Bousson ..... 160/315
7,686,061 B2 * 3/2010 Mullet et al. ..... 160/191
2002/0170688 A1 * 11/2002 Daus et al. ..... 160/315

(Continued)

*Primary Examiner* — Blair M Johnson
*Assistant Examiner* — Jaime F Cardenas-Garcia
(74) *Attorney, Agent, or Firm* — Sandy Lipkin

(57) ABSTRACT

A device that can be used as an advertising display device, an information display device or as a shade or screen that has novel ways to charge the sheet retraction spring, novel ways to prevent tampering with the charge on the spring once the device in operation and that may utilize a pull bar which allows identification of information on the sheet while in a rolled-up state without an additional label.

6 Claims, 6 Drawing Sheets

U.S. PATENT DOCUMENTS

2005/0133171 A1* 6/2005 Fan ..... 160/313
2006/0086214 A1* 4/2006 Smed ..... 81/461
2008/0314533 A1* 12/2008 Park ..... 160/313

* cited by examiner

ROLL-UP RETRACTABLE SHEET DEVICE

REFERENCE TO PRIOR APPLICATION

This application claims the priority of provisional application 60/834,665, filed Aug. 1, 2006 entitled ROLL-UP RETRACTABLE SHEET DEVICE by Gregg Seidel.

BACKGROUND OF THE INVENTION

1. Field of the Invention

This device may be used as an advertising display device, an information display device (as for a wall-mounted menu), or simply as a shade or screen.

2. Background of the Prior Art

Functionally, this device is similar to a common roll-up window shade in that a sheet of material, wound on a roller by the action of a spring, may be extended by pulling on the exposed edge of the sheet. However, this device is distinguished from previous art in the following ways.

This device has novel ways to charge the sheet retraction spring.

This device has novel ways to prevent tampering with the charge on the spring once the device is in operation.

This device may utilize a pull bar which allows identification of information on the sheet while in a rolled-up state without an additional label.

SUMMARY OF THE INVENTION

The preferred embodiment of the present invention teaches a device comprising a roller of essentially cylindrical shape having a central axis; a housing constraining the roller to rotational movement about its central axis; a sheet member of essentially rectangular shape attached at one end along one edge to the surface of the roller parallel to its central axis and having a second free end; a torsion spring attached at a first end to the housing and attached at a second end to the roller such that in operation the roller is biased to rotate in a direction which will retract the sheet member by rolling it onto the roller; a stop handle attached to the free edge of the sheet member which will facilitate manual extension of the sheet member and prevent the free edge of the sheet member from retracting into the housing; and a winding mechanism comprising a pawl having a tip which engages with a ratchet configured to allow rotational motion which would increase tension in the torsion spring and prevent rotational motion which would decrease tension in the torsion spring.

The embodiment above can be further modified by defining that the device further comprises a pin which when installed prevents the rotational motion which would increase tension in the torsion spring and prevents the rotational motion which would decrease tension in the torsion spring.

The above embodiment can be further modified by defining that the device further comprises a removable winding tool designed to engage the winding mechanism to enable charging of the torsion spring by rotationally increasing its tension.

The above embodiment can be further modified by defining that the device further comprises a blade attached to the first end of the torsion spring capable of transmitting torque to the torsion spring where the winding tool is configured to directly engage the blade.

The above embodiment can be further modified by defining that the winding tool, when applied to the winding mechanism, causes the pawl to disengage from the ratchet thus allowing rotational movement in the direction to increase tension in the torsion spring and in the direction to decrease tension in the torsion spring.

The above embodiment can be further modified by defining that the winding tool causes disengagement by displacing the pawl tip in the direction of the cylindrical axis.

The above embodiment can be further modified by defining that the winding tool causes disengagement by displacing the pawl tip in the direction of the cylindrical axis.

The above embodiment can be further modified by defining that the device further comprises a winding-only tool which is capable of engaging the winding mechanism to increase tension in the torsion spring and which is not capable of disengaging the pawl from the ratchet.

An alternative embodiment of the instant invention defines a device comprising a roller of essentially cylindrical shape having a central axis; a sheet member of essentially rectangular shape attached at a first end along one edge to the surface of the roller parallel to its central axis and having a second free end; a torsion spring attached at a first end to the housing and attached at a second end to the roller such that in operation the roller is biased to rotate in a direction which will retract the sheet member by rolling it onto the roller; a stop handle attached to the free edge of the sheet member which will facilitate manual extension of the sheet member and prevent the free edge of the sheet member from retracting into the housing; a winding mechanism further comprising a rotatable disk attached to the first of the torsion spring having one or more fingers biased outward; and a circular enclosure fixed to the housing having one or more pockets on its internal periphery which while one or more fingers of the disk are situated in the pockets, prevents the first end of the torsion spring from rotating; and a winding tool which, when engaged, pushes one or more fingers out of one or more pockets thereby allowing the tension in the torsion spring to be increased.

The above embodiment can be further modified by defining that the winding tool which, when engaged, pushes one or more fingers out of one or more pockets thereby allowing the tension in the torsion spring to be decreased.

DETAILED DESCRIPTION OF A PREFERRED EMBODIMENT

Figure 1:
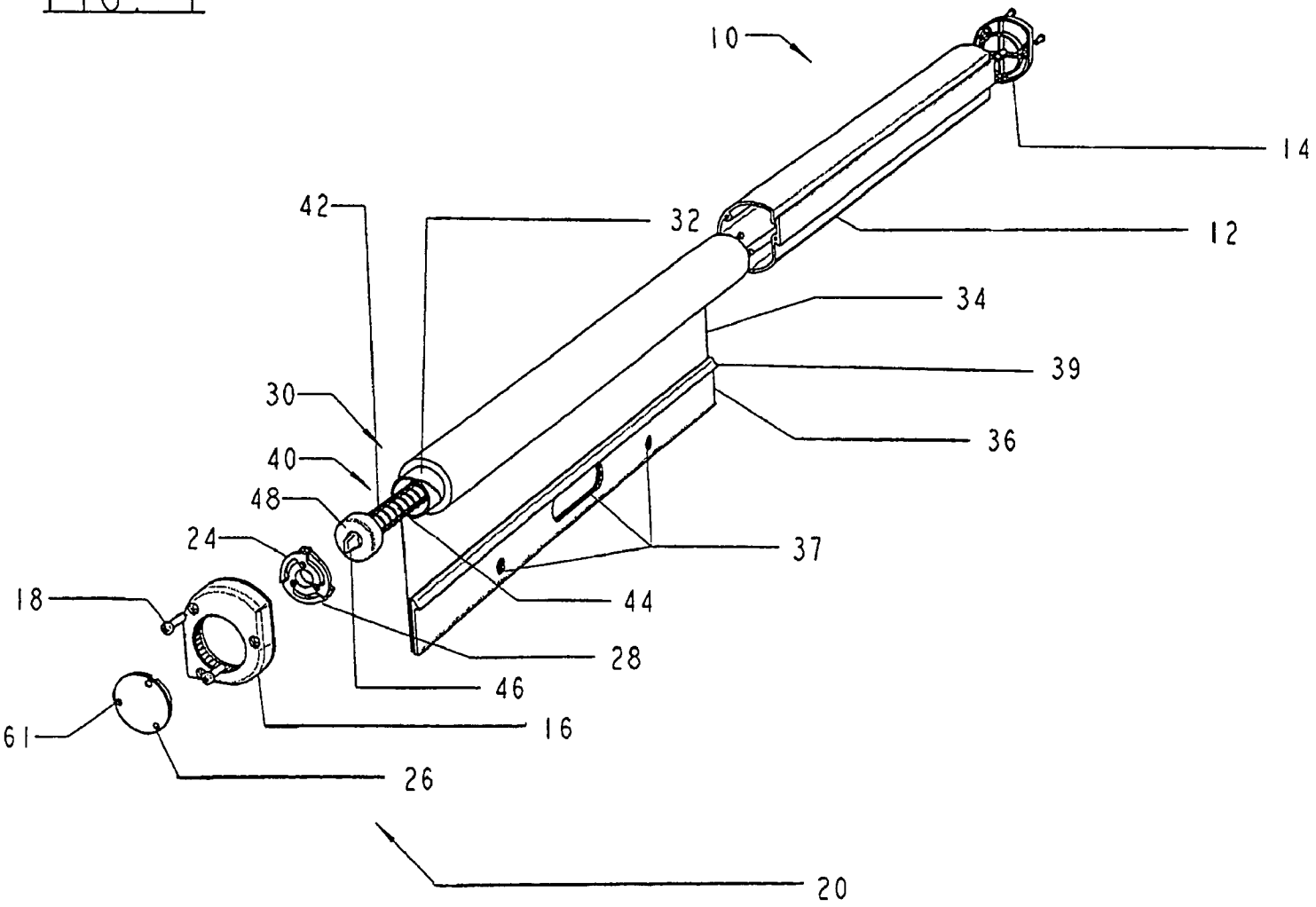
FIG. 1 is an exploded view of the one embodiment of the device.

Turning to the drawings, the preferred embodiment is illustrated and described by reference characters that denote similar elements throughout the several views of the instant invention.

FIG. 1 is an exploded view of one embodiment of the device. Housing 10 comprises housing extrusion 12, left end cap 14, right end cap 16, and screws 18. Right end cap assembly 20 comprises right end cap 16, finger disk 24, cover disk 26, and screws 28.

Roller assembly 30 comprises roller tube 32, torsion spring assembly 40 at one end of roller tube 32 and a stub axle (not shown) at the other end of the roller tube 32, sheet 34 attached along one edge to roller tube 32, and pull bar 36 attached to the free edge of sheet 34. Holes 37 go through pull bar 36 and sheet 34. Stop ridge 39 prevents pull bar 36 from being pulled into housing extrusion 12 (see also FIG. 6).

Torsion spring assembly 40 comprises torsion spring 42, rod 44, blade 46, and cap 48. One end of torsion spring 42 is attached to cap 48 which is secured to roller tube 32. The other end of torsion spring 42 is attached to one end of rod 44. Rod 44 passes through the center of torsion spring 42. The other end of rod 44 is attached to blade 46.

In operation blade 46 remains stationary relative to housing 10. Torsion spring 42, having a certain charge or tension, biases roller tube 32 to rotate tending to roll sheet 34 onto roller tube 32. To change the charge or tension in torsion spring 42, blade 46 must be rotated relative to housing 10.

Figure 2:
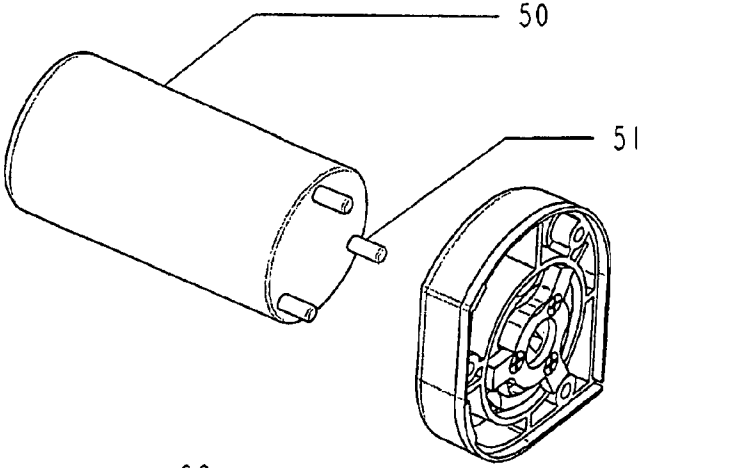
FIG. 2 shows a right end cap assembly assembled along with the winding tool.
Figure 2A:
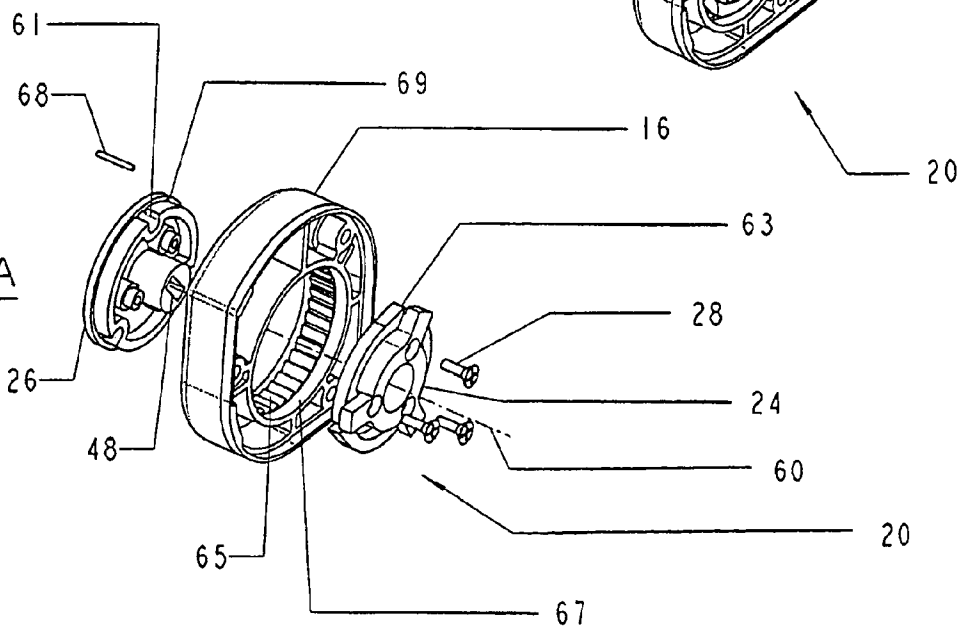
FIG. 2A shows a right end cap assembly as in FIG. 2, but in an exploded view.

FIG. 2 shows right end cap assembly 20 in assembled and exploded views. FIG. 2 further shows winding tool 50. Right end cap assembly 20 constitutes a mechanism to facilitate the winding or charging of torsion spring 42 prior to operation. Slot 48 in cover disk 26 mates with blade 46. Finger disk 24 is fastened to cover disk 26 using screws 28 with right end cap 16 sandwiched in between so that movement relative to right end cap 16 is constrained to rotational movement. Finger disk 24 is made of a springy material such as acetal plastic.

Tips of fingers 63 are biased outward (radially) to engage ratchet wall 65. This combination acts as ratchet and pawl—allowing rotation in one direction (acting to charge or increase the tension in torsion spring 42) and disallowing rotation in the other direction.

To charge torsion spring 42 pegs 51 of winding tool 50 are inserted in through peg holes 61 of cover disk 26. This allows torsion to be transmitted from winding tool 50 to cover disk 26 to blade 46 to rod 44 to one end of torsion spring 42.

Peg holes 61 are aligned with tips of fingers 63 so that by pushing winding tool 50 in further pegs 51 will displace tips of fingers 63 axially (in a direction parallel to central axis 60). Displacement of tips of fingers 63 from contact with ratchet wall 65 to contact with smooth wall 67 allows rotation of finger disk 24 in either direction. Consequently, with a winding tool 50 with pegs 51 of appropriate length torsion spring 42 may be charged or discharged to any degree desirable.

A variation of winding tool 50 has shorter pegs (not shown) so that when it is fully inserted tips of fingers 63 are not displaced and tension in torsion spring 42 can only be increased. Winding tool 50 may be adapted to couple to a powered driver (not shown).

Subsequent to winding torsion spring 42 to the desired tension, a locking pin 68 may be pressed in through pin hole 69 and between the teeth of ratchet wall 65. This prevents rotary movement of cover disk 26 relative to right end cap 16 so that the retraction force on sheet 34 can not be altered. Locking pin 68 may also protrude into a pocket (not shown) in finger disk 24.

Figure 3A:
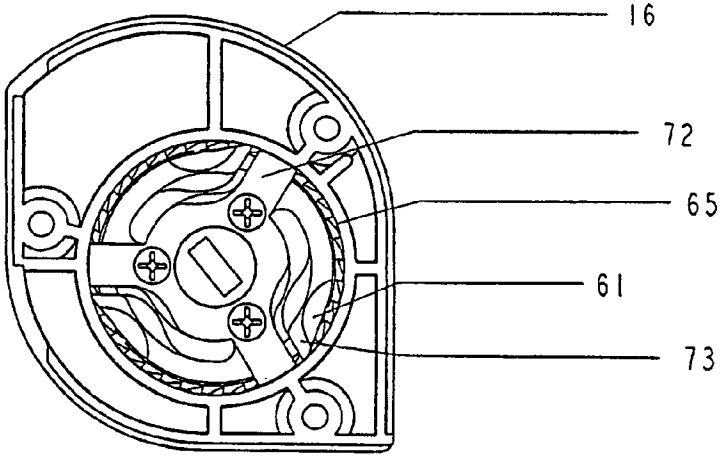
FIG. 3A shows the right end cap assembly view from the inside.
Figure 3:
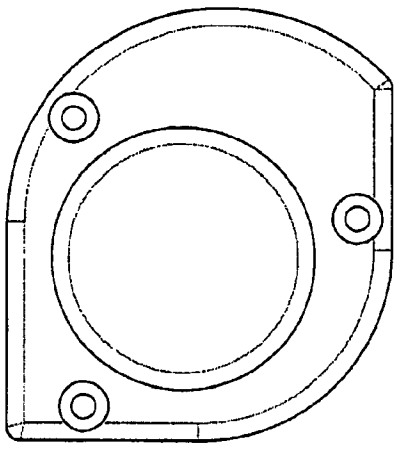
FIG. 3 shows the right end cap assembly view from the outside.
Figure 3B:
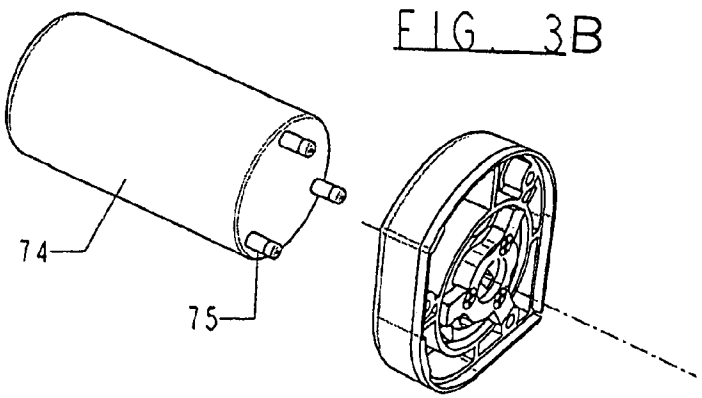
FIG. 3B shows a variation of the winding tool and the finger parts

FIG. 3 shows a variation of right end cap assembly 20. The view outside of right end cap assembly 70 does not include cover disk 26. Finger disk 72 and winding tool 74 are modified from corresponding parts previously described. Tips of fingers 73 engage ratchet wall 65 as before but action of the winding tool pegs 75 displaces tips of fingers 73 inwardly rather than axially.

Figure 4A:
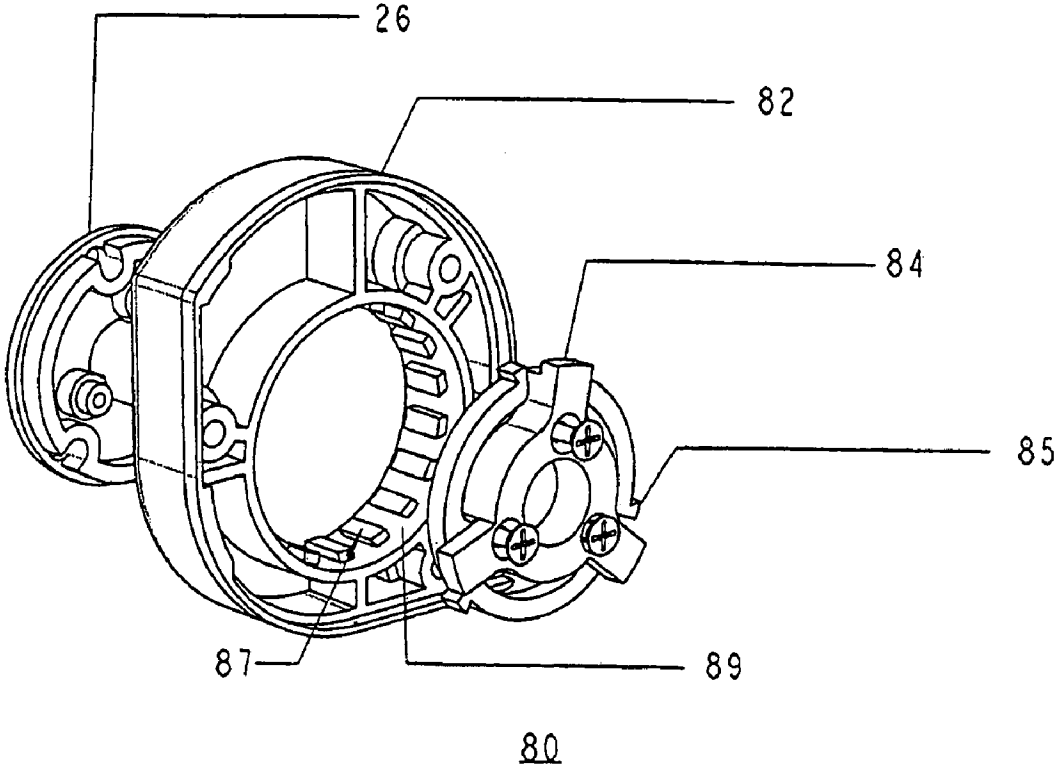
FIG. 4A shows another variation of the right end cap assembly as shown in FIG. 4, but in an exploded view.
Figure 4:
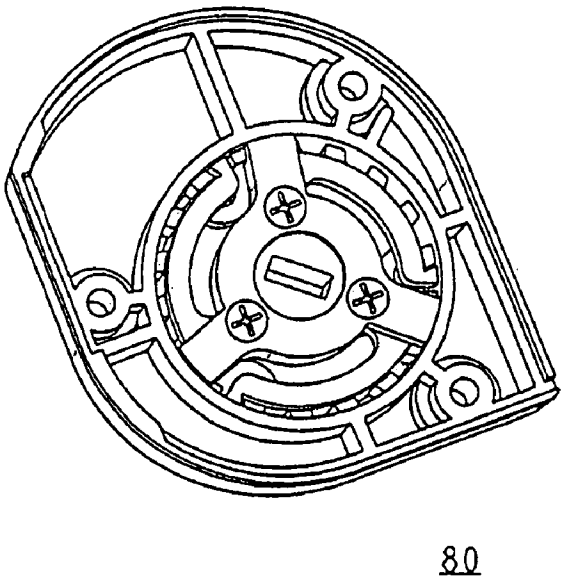
FIG. 4 shows another variation of right end cap assembly assembled.

FIG. 4 shows another variation 80 of right end cap assembly 20. In this variation tips of fingers 85, when in contact with stop wall 87, prevent rotation of finger disk 84 in either direction. Winding tool 50 is used to displace tips of fingers 85 axially from contact with stop wall 87 to contact with smooth wall 89, thereby allowing rotation in either direction.

Figures 5, 5A:
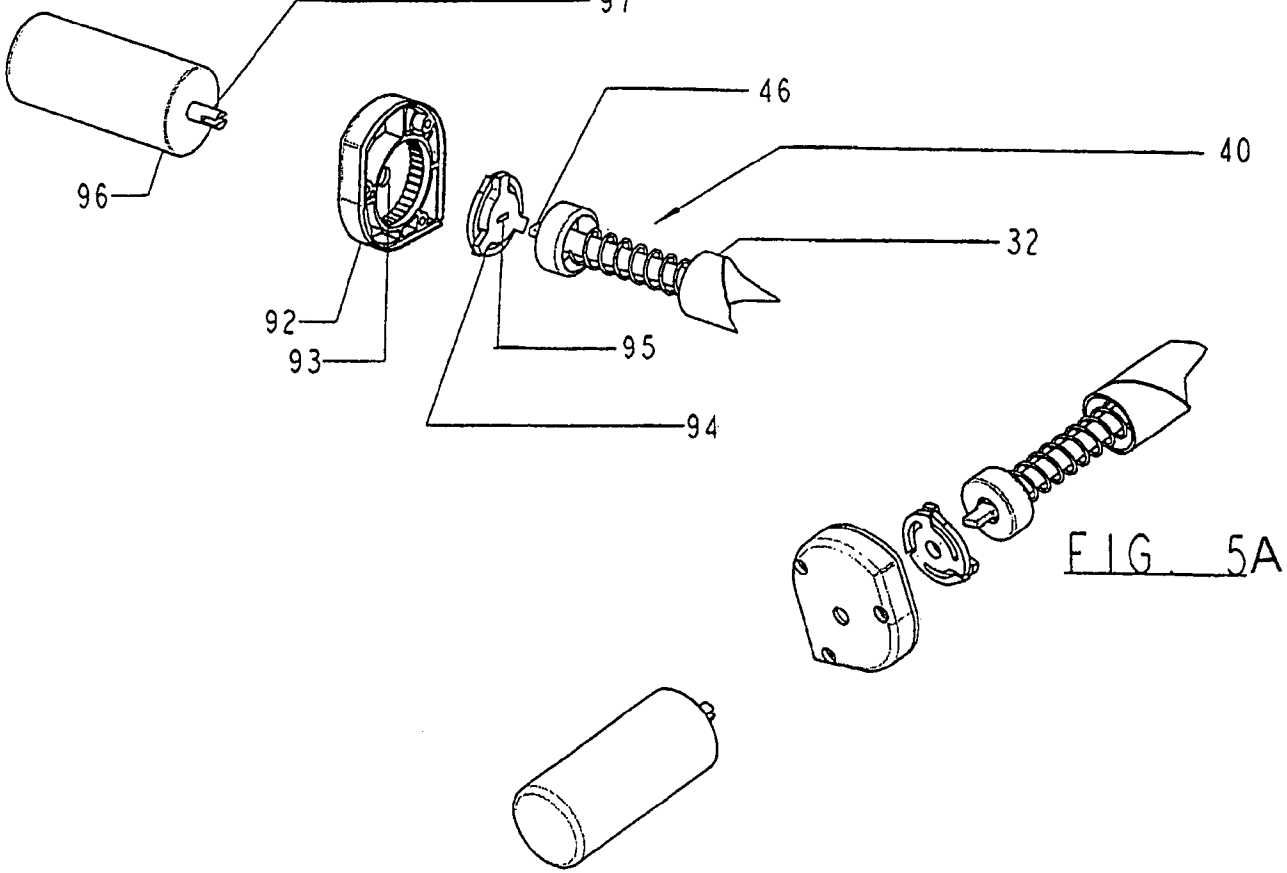
FIG. 5 is an exploded perspective view of a winding mechanism.
FIG. 5A is the exploded perspective view of FIG. 5, but from the opposite direction.

FIG. 5 is an exploded view of a winding mechanism. In this variation slotted shaft 97 of winding tool 96 mates directly with blade 46 of torsion spring assembly 40. Right end cap 92 has a small hole 93 for slotted shaft 97 to go through. Finger disk 94 has a slot 95 to register it to blade 46.

Figure 6:
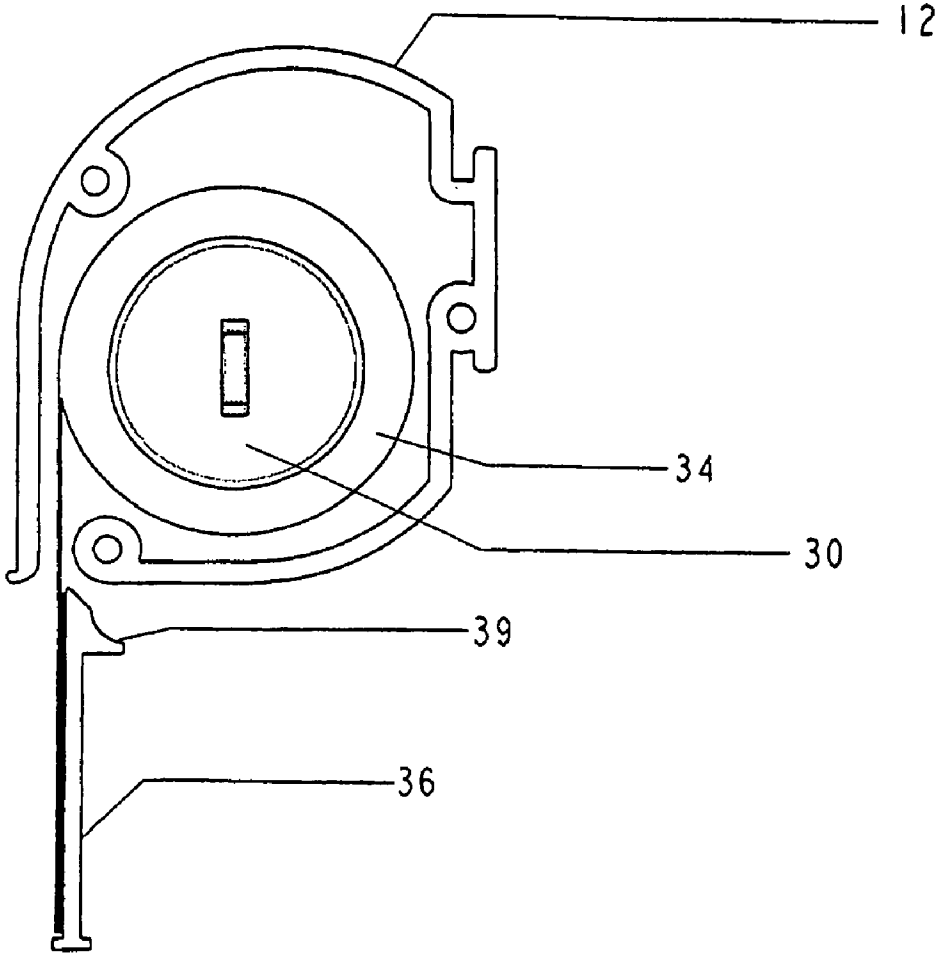
FIG. 6 is a right end view of the device with the right end cap assembly removed.

FIG. 6 is a right end view of the device with right end cap assembly (20, 70, 80, 90) removed. Pull bar 36 has a stop ridge 39 which prevents pull bar 36 from retracting into housing extrusion 12 and, while sheet 34 is fully retracted, positions pull bar 36 appropriately. Pull bar 36 is attached to the backside of sheet 34. This allows a message printed on sheet 34 to be identifiable even with sheet 34 fully retracted. Pull bar 36 may have holes 37 (see FIG. 1) which allows sheet 34 to be pulled down and kept down by use of externally mounted hooks (not shown).

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

What is claimed is:

1. A device comprising a roller of essentially cylindrical shape having a central axis;

a housing constraining the roller to rotational movement about its central axis, said roller having a first end and a second end, said first end having one or more apertures therethrough;

a sheet member of essentially rectangular shape attached at one end along one edge to the surface of the roller parallel to its central axis and having a second free end;

a torsion spring attached at a first end to the housing and attached at a second end to the roller such that in operation the roller is biased to rotate in a direction which will retract the sheet member by rolling it onto the roller;

a stop handle attached to the free edge of the sheet member which will facilitate manual extension of the sheet member and prevent the free edge of the sheet member from retracting into the housing;

a winding mechanism that facilitates adjustment of the tension in said torsion spring and that winds said torsion spring comprising a pawl having a tip which engages with a ratchet configured to allow rotational motion which would increase tension in the torsion spring and prevent rotational motion which would decrease tension in the torsion spring, said winding mechanism having three apertures spaced substantially 120 degrees from each other in a substantially circular plane; and a removable winding tool that is a separate part from said device and not attached thereto that is designed to engage the winding mechanism to enable charging of the torsion spring by rotationally increasing its tension wherein said winding tool is cylindrical in shape having a first end, a second end and a cylindrical outer surface connecting said first end to said second end and wherein said winding tool has three protuberances that mate with said three apertures in said winding mechanism said protuberances being spaced substantially 120 degrees from each other in a substantially circular plane.

2. A device as defined in claim 1 wherein the device further comprises a pin that is installed after said torsion spring is wound to a pre-set tension which when installed prevents the rotational motion which would increase tension in the torsion spring and prevents the rotational motion which would decrease tension in the torsion spring.

3. A device as defined in claim 1 wherein the device further comprises a blade attached to the first end of the torsion spring capable of transmitting torque to the torsion spring where the winding tool is configured to directly engage the blade.

4. A device as defined in claim 1 wherein the winding tool, when applied to the winding mechanism, causes the pawl to disengage from the ratchet thus allowing rotational movement in the direction to increase tension in the torsion spring and in the direction to decrease tension in the torsion spring.

5. A device as defined in claim 4 wherein the winding tool causes disengagement by displacing the pawl tip in the direction of the cylindrical axis.

6. A device as defined in claim 4 wherein the device further comprises a winding-only tool that adjusts the tension of said torsion spring relative to the position of said sheet member which is capable of engaging the winding mechanism to increase tension in the torsion spring and which is not capable of disengaging the pawl from the ratchet.

* * * * *